US005188154A

United States Patent [19]

Christe et al.

[11] Patent Number: 5,188,154

[45] Date of Patent: Feb. 23, 1993

[54] WEAVING ROTOR COMB FIN DESIGN FOR SERIES-SHED LOOM

[75] Inventors: Marcel Christe; Walter Koch; Peter Grimm, all of Rüti, Switzerland

[73] Assignee: Sulzer Brothers Limited, Winterthur, Switzerland

[21] Appl. No.: 848,801

[22] Filed: Mar. 9, 1992

[30] Foreign Application Priority Data

May 21, 1991 [CH] Switzerland ..... 01500/91

[51] Int. Cl.[5] ..... D03C 13/00

[52] U.S. Cl. ..... 139/28; 139/11

[58] Field of Search ..... 139/11, 28

[56] References Cited

U.S. PATENT DOCUMENTS 4,291,729 9/1981 Steiner ..... 139/28
4,487,233 12/1984 Steiner ..... 139/28
4,498,501 2/1985 Steiner ..... 139/28
4,655,259 4/1987 Steiner ..... 139/435.6 X

FOREIGN PATENT DOCUMENTS 0093078 11/1983 European Pat. Off. .
0196349 10/1986 European Pat. Off. .

*Primary Examiner*—Andrew M. Falik
*Attorney, Agent, or Firm*—Townsend and Townsend

[57] ABSTRACT

A series-shed loom with a weaving rotor (1) and laying-in members (2) which lay the warp threads (3) into high points and low points on the weaving rotor (1) to form the sheds, while the weaving rotor combs through the sheds (6) so formed to beat-up against a beater bar (8) of a meanwhile inserted weft yarn (7). Warp threads (3*a*, 3*b*) are laid into gaps (11) in the combs, while the low points (5) of one warp thread (3) are formed in gaps (11) which are in line in the direction of rotation (9). The high points (4) for one warp thread (3*a*, 3*b*) are formed by fins (12) which are in line in the direction of rotation and which form longitudinal saddles (13*a*, 13*b*) extending in the direction of rotation (9) between a beater nose (14) and a holder nose (15). To facilitate an interference-free laying in of two warp threads (3*a*, 3*b*) in one gap (11), the fin adjoining them on their left is assigned to the left-hand warp thread, and the fin adjoining them on their right is assigned to the right-hand warp thread for possible high points (4).

9 Claims, 4 Drawing Sheets

WEAVING ROTOR COMB FIN DESIGN FOR SERIES-SHED LOOM

BACKGROUND OF THE INVENTION

The invention deals with a series-shed loom with a weaving rotor and laying-in members which lay the warp threads into high points and low points on the weaving rotor to form the sheds, while the weaving rotor combs through the sheds so formed, round to the beat-up against a beater bar of a weft yarn which has meanwhile been inserted, the weaving rotor exhibiting transversely to the direction of rotation, combs with gaps and fins.

Series-shed looms with weaving rotors are shown in patent specifications DE-OS 23 18 795, SU 186 898 and EP 0 196 349. One problem for series-shed looms arises from the fact that the geometry of the shed-forming members and of the beater fins cannot be scaled down indefinitely in order to generate a close weave. Mechanical limits are set to the accuracy of laying the warp threads in gaps and to restricting the width of the gaps.

SUMMARY OF THE INVENTION

Here the invention creates a remedy. It solves the problem of laying warp threads in closely. In accordance with the invention the problem is solved by laying at least one warp thread in each gap, by the low points of one warp thread lying in gaps which are in line in the direction of rotation, by the high points for one warp thread being formed in each case on a fin by a longitudinal saddle along the direction of rotation of the weaving rotor as a saddle point between a beater nose and a holder nose in line with the latter in the direction of rotation, and by the warp thread from one gap being laid in over a longitudinal saddle and round the holder noses of fins in line with one another in the direction of rotation and assigned to that warp thread.

The advantages of the invention lie in the fact that a relatively close weave is generated, that warp threads are prevented from crossing in the plan of the weaving rotor and that the risk of false laying-in is reduced.

DESCRIPTION OF THE PREFERRED EMBODIMENTS

Figure 1:
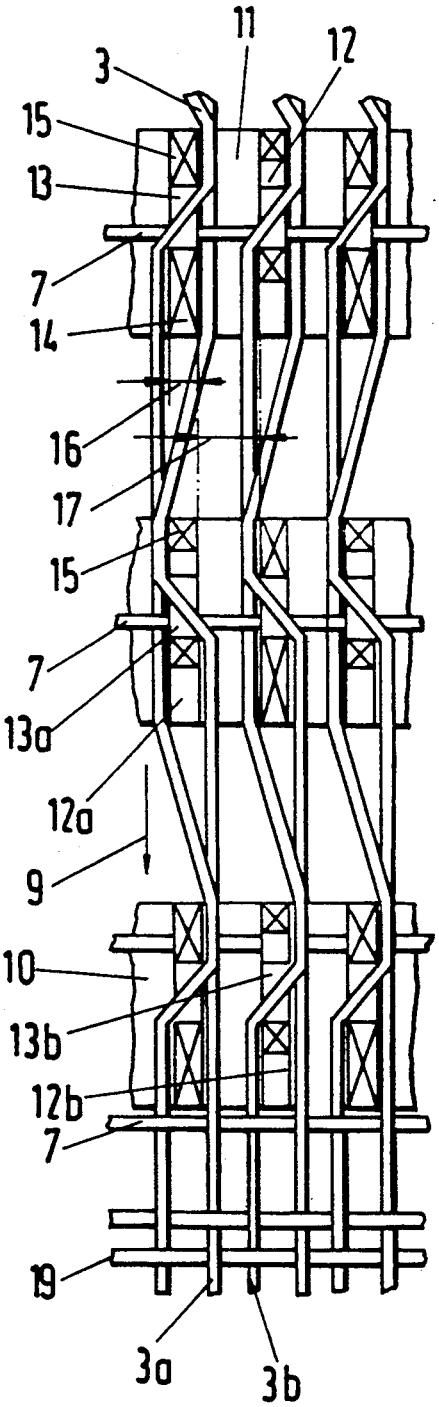
FIGS. 1, 2—Show in the unwound state, the run of the warp threads on a weaving rotor, a high point being formed in each case by a longitudinal saddle on the fins.

In the Figures a series-shed loom is shown having a weaving rotor 1 and laying-in members 2 which lay the warp threads 3 into high and low points 4, 5 on the weaving rotor to form the shed, while the weaving rotor 1 combs through the sheds so formed, beating-up weft yarn 7, which has meanwhile been, against a beater bar 8. In accordance with the invention warp threads are laid in the gaps in the combs, the low points of one warp thread lying in gaps which are aligned in the direction of rotation and the high points for one warp thread being formed on fins 12 which are also aligned with one another in the direction of rotation, by respective longitudinal saddles 13 along the direction of rotation, each as a saddle point 20 between a beater nose 14 and a holder nose 15. In the case of two warp threads in one gap, for laying-in free of crossing, the fin 12 adjoining them on their left is assigned to the left-hand warp thread and the fin adjoining them on their right is assigned to the right-hand warp thread for possible high points.

In FIG. 1 on a greatly exaggerated scale transversely to the direction of rotation 9 the last three rows of combs 10 before beat-up against a cloth 19 are shown. Two warp threads 3*a*, 3*b* have their low points 5 offset in the direction of rotation in a common gap 11 of gap width 17 which corresponds with at least twice the thickness of warp thread and are bounded by fins 12*a*, 12*b* which form the respective high points 4, each of which is formed by a longitudinal saddle 13*a*, 13*b* aligned in the direction of rotation, with a saddle point 20 between the beater nose 14 and the holder nose 15. The width 16 of the fins—as long as the strength properties of the fin material allow it—may be chosen to be less than the gap width 17 in order to obtain a regular cloth 19. For facilitating the space relationships during beat-up of a weft yarn 7 as well as during the laying-in of the warp threads 3, the beater nose and holder nose may exhibit an offset with respect to one another both transversely over one comb 10 and from comb to comb in the direction of rotation 9.

Figure 2:
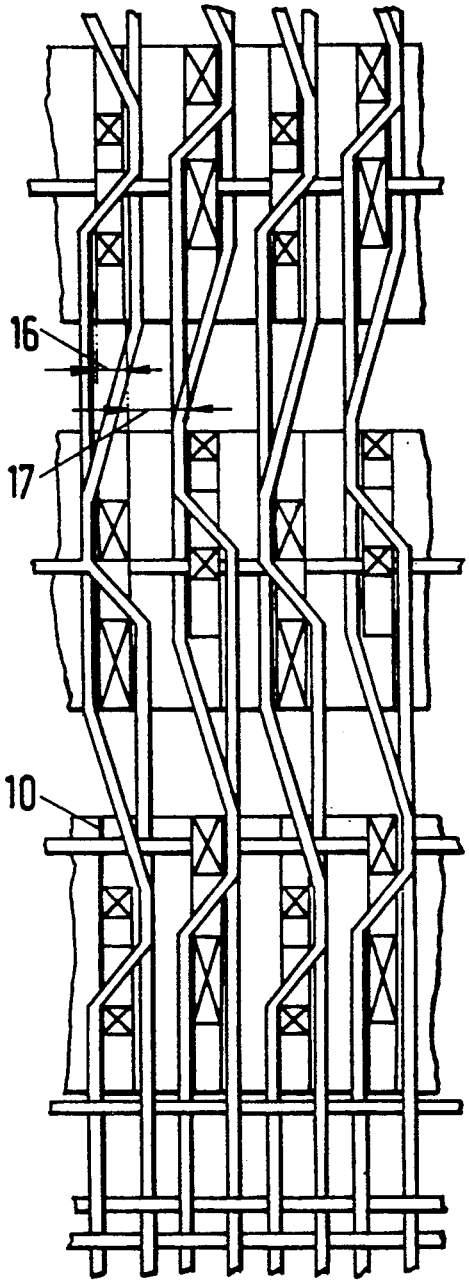

In FIG. 2 the position of the longitudinal saddle 13 of adjacent fins of one comb is in each case shifted by one offset in the direction of rotation 9.

Figure 3:
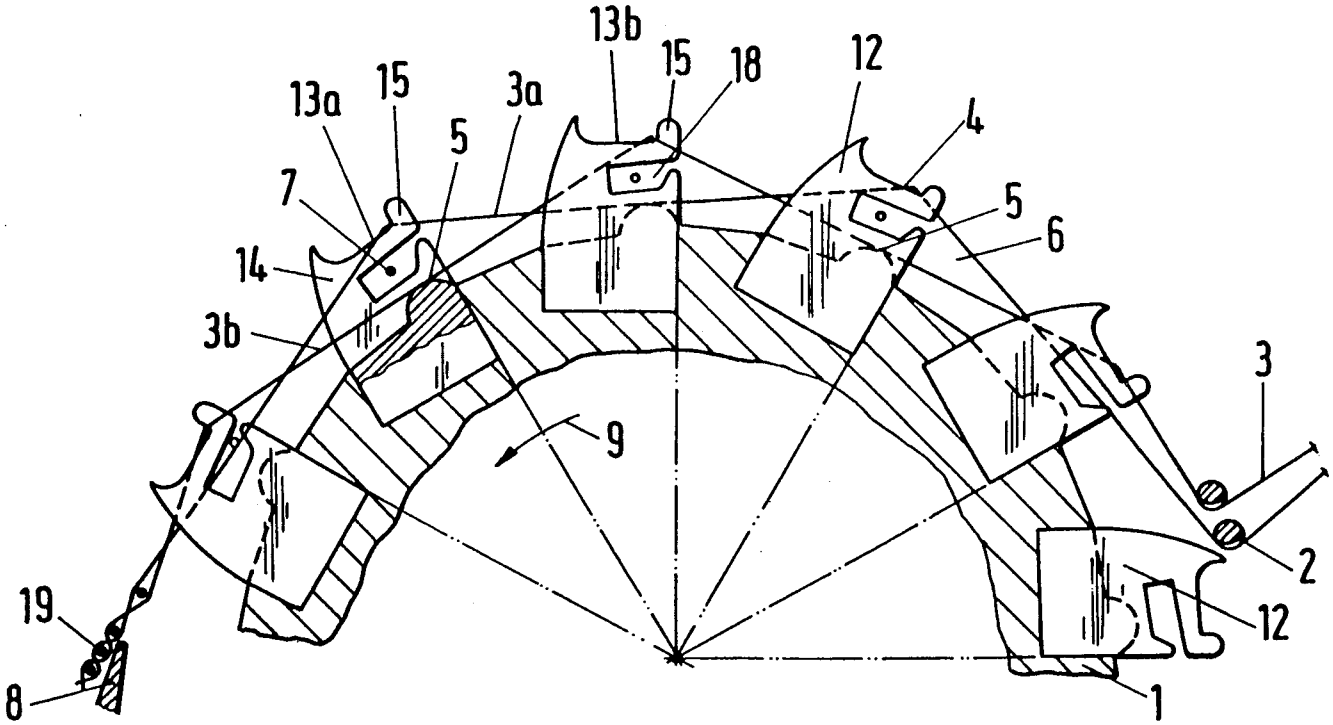
FIG. 3—Shows a section through the weaving rotor of a series-shed loom with the run of the warp threads from the laying-in members round to the beater members.
Figure 4:
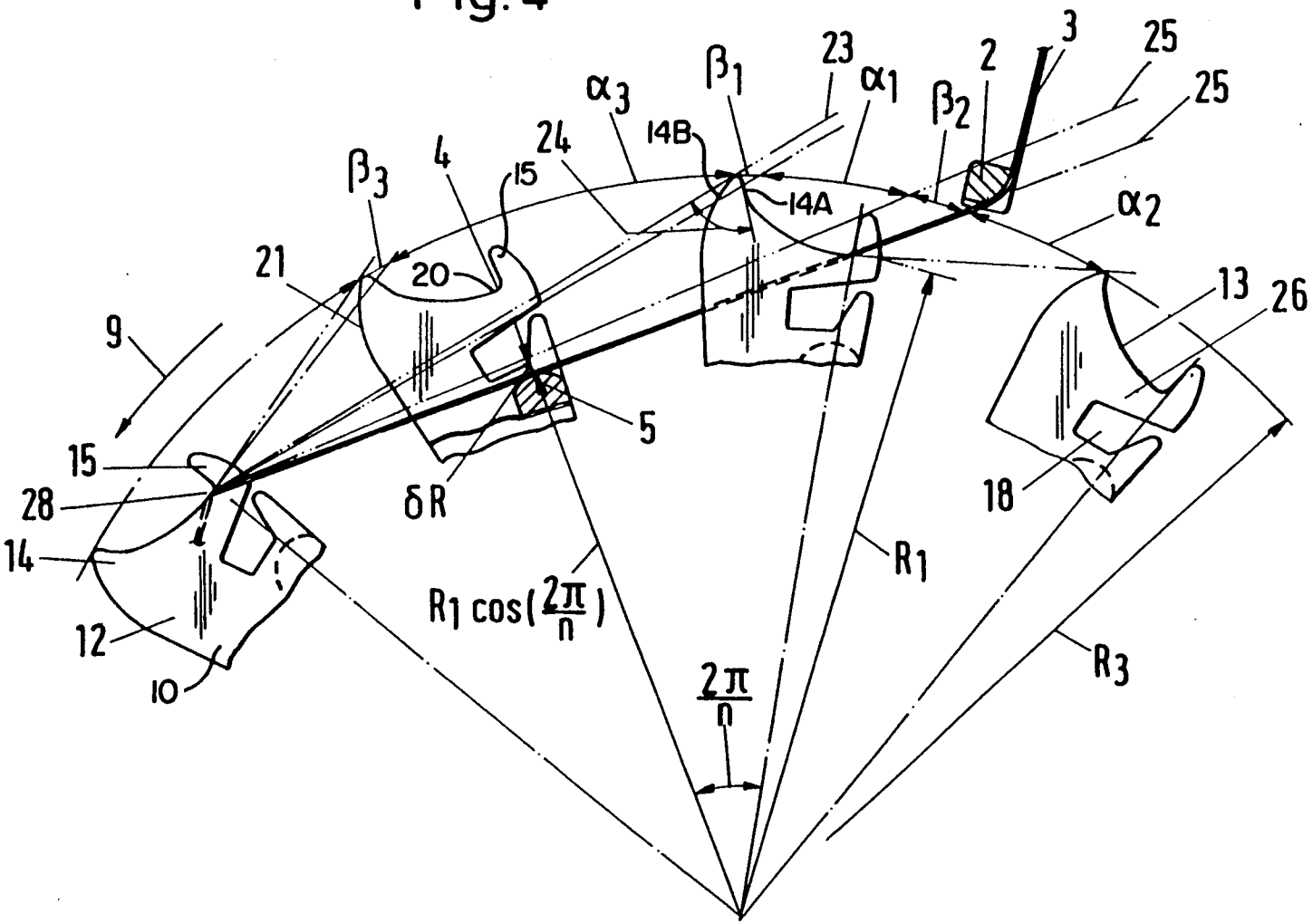
FIG. 4—Shows a section through a weaving rotor with combined laying-in and beater fins as well as the geometric relationships during laying in by laying-in members.

In FIGS. 3 and 4 the geometric relationships are described more exactly. The movements between the weaving rotor 1 and the laying-in members 2 must be coordinated so that the laying-in members 2 may start a partial movement at the earliest at a certain angle of rotation of the weaving rotor and must have concluded the partial movement at the latest at a certain later angle of rotation. If the partial movement is made sideways quicker than necessary, in order to lay a warp thread 3, 3*a*, 3*b* over a longitudinal saddle 13, 13*a*, 13*b* within an angle of rotation $\alpha_1$, there exists firstly a reserve of time or respectively safety in laying-in over the longitudinal saddle 13, 13*a*, 13*b* and secondly through the short distances between the laying member and the longitudinal saddle 13, 13*a*, 13*b* with the holder nose 15 greater angular distances sideways to the adjacent holder noses 15 arise than if the warp thread is stretched between the comb row lying before it in the direction of rotation and the laying-in members. The laying-in over the longitudinal saddle 13, 13*a*, 13*b* into the succeeding gap 11 between two holder noses 15 allows a greater inaccuracy in the position of the laying-in member 2. Through the deflection over a longitudinal saddle 13, 13*a*, 13*b* there is a greater range of laying-in available for the sideways deflection.

Figure 5:
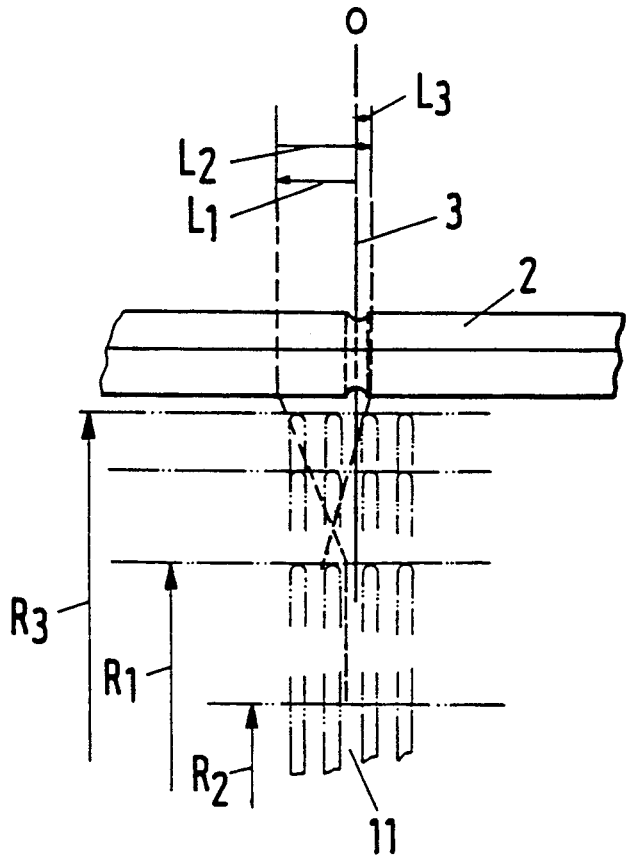
FIG. 5—Shows the laying stroke of a laying-in member.

In FIG. 5, starting from a zero position in which a warp thread 3 is assigned to a gap 11, the laying stroke $l_1$ is shown for the laying-in over the longitudinal saddle 13, the laying stroke $l_2$ for the return travel after the catching of the warp thread 3 by the holder nose 15, and a possible laying stroke $l_3$ for reaching the zero position. In doing so the laying stroke $l_1$ must be executed within the angle of rotation $\alpha_1$, the laying stroke $l_2$ within the angle of rotation $\alpha_2$ and the laying stroke $l_3$ within the angle of rotation $\alpha_3$.

In FIG. 4 the influence of the shape of fin is shown. In order to keep open the action of the longitudinal saddle 13 as a guide member over a wide range of angle $\alpha_1$ for the sideways deflection, the geometry of the fins 12 is so designed that the smallest possible blocking range for sideways movements of the laying-in member 2 arises with the lost angles $\beta_1$, $\beta_3$ at which the warp threads 3 might jump away sideways over the beater nose 14. This is done by the beater nose 14 having an outward curvature 14B on the beater side 21 for beating up the weft yarn 7 and an inward curvature 14A on the rear side next the longitudinal saddle 13. The steepest pitch on the rear side of the beater nose 14 makes with the straight line 23 joining the saddle point 28 lying next to but one in front of it in the direction of rotation 9 to the tip of the beater nose, an angle 24 of less than 95°. Referred to the axis of rotation of the weaving rotor the saddle point 20 of the longitudinal saddle 13 of radius $R_1$ lies directly in front of the holder nose 15 in order to catch the warp thread securely and in order to manage with only a small elevation of the holder nose 15, which likewise generates only a small lost angle $\beta_2$ at which the warp thread might jump back sideways. To correspond with the lost angle $\beta_2$ at the boundaries 25 of the holder nose 15 there arises at the row of combs lying in front of it in the direction of rotation 9 a section of radius $\delta R$ within which another low point 5 of the shed 6 is possible with resting of the warp thread, without the catching of the warp thread by the holder nose 15 becoming distrubed by the engagement of the point of rest. The radius $R_2$ for the low point 5 in that case satisfies the equation $$R_1 \cos(2\pi/n) + \delta R \geqq R_2 > R_1 \cos(2\pi/n)$$

in which $R_1$ corresponds with the radius of the saddle point 20 and n with the number of combs 10 at the circumference of the weaving rotor.

In the region between the weft channel 18 and the longitudinal saddle 13 the fins 12 act like leaf springs 26 which might yield under forces transversely to the direction of rotation 9. The bending resistance of these leaf springs 26 and the deflecting forces on the warp threads are matched to one another in such a way that no inadmissible deflections arise transversely to the direction of rotation 9. In order to keep the loading on the warp threads 3 and the fins 12 small, the fins 12 in regions where they touch the yarn are given smooth surfaces and made without sharp edges but rounded to protect the yarn. The surfaces exhibit not only a low coefficient of friction but they are also made of wear-resistant material.

What is claimed is:

1. A series-shed loom with a weaving rotor (1) and laying-in members (2) which lay warp threads (3) into high points and low points on the weaving rotor (1) to form sheds (6), while the weaving rotor (1) combs through the sheds so formed, beating-up weft yarns (7), which have meanwhile been inserted in the sheds, against a beater bar (8), the weaving rotor (1) including gaps (11) and fins (12) forming said high points and low points in combs (10) transversely to the direction of rotor rotation (9), characterized in that at least one warp thread (3, **3*a*, 3*b*) is laid in each gap (11), the low points (5) of a warp thread (3) lying in gaps (11) which are aligned in the direction of rotation (9), the high points (4) for another warp thread (3, 3*a*, 3*b*) being formed in each case on a fin (12), the high points being defined by longitudinal saddles (13, 13*a*, 13*b*) formed by the fins, the saddles extending in the direction of rotation (9) of the weaving rotor (1) and including a saddle point (20) between a beater nose (14) and a holder nose (15) of each fin, the beater noses and the holder noses being aligned in the direction of rotation (9), the warp thread (3, 3*a*, 3*b*) from one gap (11) being laid in over a longitudinal saddle (13, 13*a*, 13*b*) and about the holder noses (15) of fins (12) aligned with one another in the direction of rotation (9**) and assigned to that warp thread.

2. A series-shed loom as in claim 1, characterized in that the gaps (11) have a width corresponding to at least twice the thickness of the warp yarn, and in that two warp threads (**3*a*, 3*b*) are laid in each gap (11**).

3. A series-shed loom as in claim 1, characterized in that the fins (12) include regions touching the thread, said regions being formed with rounded edges to ease the threads and having a surface with a low coefficient of friction with respect to the warp yarn (3).

4. A series-shed loom as in claim 1,
characterized in that surfaces of the fins (12) exposed to the warp threads (3) are made of a wear-resistant material.

5. A series-shed loom as in claim 1,
characterized in that within one comb (10) the beater nose and the holder nose on one fin (12) are spaced with an offset in the direction of rotation (9) from the beater nose and the holder nose on the directly adjacent fin (12).

6. A series-shed loom as in claim 1, characterized in that the saddle point (20) of the longitudinal saddle (13) lies directly in front of the holder nose (15).

7. A series-shed loom as in claim 1, characterized in that the beater noses (14) are curved outwards on a front side and inwards on a rear side next to the longitudinal saddle (13) for generating small dead angles $\beta_1$, $\beta_3$, within which no laying-in motion of a warp thread (3) transversely to the direction of rotation (9) is possible.

8. A series-shed loom as in claim 7, characterized in that a steepest pitch of the beater nose (14) at the side next to the longitudinal saddle (13) forms an angle (24) of less than 95° with the straight line (23) joining the saddle point (20) lying next but one in front of it in the direction of rotation (9) with a tip of the beater nose (14).

9. A series-shed loom as in claim 1, characterized
in that for a low point (5) with warp threads still lying on it a distance $R_2$ to the axis of rotation of the weaving rotor (1) corresponds to $$R_1 \cos(2\pi/n) + \delta R \geqq R_2 > R_1 \cos(2\pi/n)$$

where $\delta R$ is determined by the boundaries (25) for a dead angle $\beta_2$ within which no laying-in motion transversely to the holder nose (15) is possible and where n corresponds with the number of combs (10) on the circumference of the weaving rotor (1).

* * * * *